US007550636B2

(12) United States Patent
Picard et al.

(10) Patent No.: US 7,550,636 B2
(45) Date of Patent: Jun. 23, 2009

(54) PROCESS FOR THE HYDROTREATMENT OF AN OLEFINIC GASOLINE COMPRISING A SELECTIVE HYDROGENATION STAGE

(75) Inventors: Florent Picard, Saint Symphorien d'Ozon (FR); Sebastien Leplat, Lyons (FR)

(73) Assignee: Institut Francais du Petrole, Rueil Malmaison Cedex (FR)

( * ) Notice: Subject to any disclaimer, the term of this patent is extended or adjusted under 35 U.S.C. 154(b) by 557 days.

(21) Appl. No.: 11/286,297

(22) Filed: Nov. 25, 2005

(65) Prior Publication Data

US 2006/0135829 A1 Jun. 22, 2006

(30) Foreign Application Priority Data

Nov. 26, 2004 (FR) ..... 04 12592

(51) Int. Cl.
*C07C 7/163* (2006.01)
*C10G 45/00* (2006.01)

(52) U.S. Cl. ..... 585/258; 585/261; 585/262; 208/57; 208/145

(58) Field of Classification Search ..... 585/258, 585/261, 262; 208/57, 145
See application file for complete search history.

(56) References Cited

U.S. PATENT DOCUMENTS

| | | | |
|---|---|---|---|
| 3,471,400 | A | 10/1969 | Cosyns et al. |
| 3,492,220 | A | 1/1970 | Lempert et al. |
| 5,356,851 | A | 10/1994 | Sarrazin et al. |
| 2003/0221994 | A1 | 12/2003 | Ellis et al. |

FOREIGN PATENT DOCUMENTS

| | | |
|---|---|---|
| WO | WO 03102114 | 12/2003 |

*Primary Examiner*—Thuan Dinh Dang
(74) *Attorney, Agent, or Firm*—Millen, White, Zelano & Branigan, P.C.

(57) ABSTRACT

The invention relates to a process for the hydrotreatment of an olefinic gasoline comprising at least one selective hydrogenation stage, and generally of simultaneous conversion of mercaptans by weight increase, in which the makeup hydrogen used in this stage or these stages has a reduced $CO+CO_2$ content, preferably comprised between 5 and 200 ppmv. Most often, the CO content is comprised between 1 and 20 ppmv. The process typically makes it possible to hydrorefine an olefinic gasoline by more or less eliminating the diolefins and sulphur compounds.

18 Claims, No Drawings

PROCESS FOR THE HYDROTREATMENT OF AN OLEFINIC GASOLINE COMPRISING A SELECTIVE HYDROGENATION STAGE

FIELD OF THE INVENTION

The present invention relates to a process for the selective hydrotreatment of an olefinic gasoline containing polyunsaturated compounds (diolefins and acetylenics) on a sulphurized compound. It also, preferably, relates to a hydrotreatment process linking such a selective hydrogenation stage and a stage of selective conversion of the saturated sulphur compounds of this same gasoline, or of part of the selectively hydrogenated gasoline. The process according to the invention uses hydrogen comprising a limited CO and/or $CO_2$ content, this limited content being able, when it is not zero, to allow the use of more varied and/or reduced-cost hydrogen sources.

According to the invention, a selective hydrogenation process is a process allowing the substantial hydrogenation of the polyunsaturated compounds (at least 70%, preferably at least 80% and very preferably at least 90%), with a limited concomitant level of hydrogenation of the mono-unsaturated compounds (olefins) (less than 15%, preferably less than 10% and very preferably less than 5%).

PRIOR ART

Future motor-fuel specifications provide for a considerable reduction in the sulphur content of these fuels, and of gasolines in particular. In the industrialized countries, current specifications relating to sulphur content are of the order of 150 ppm by weight and will be reduced in the years to come to reach contents of less than 10 ppm after a transition to 50 ppm by weight. The development of specifications relating to sulphur content of fuels thus requires the perfecting of new processes for deep desulphurization of gasolines.

The chief sources of sulphur in the gasoline bases are so-called cracked gasolines and, chiefly, the gasoline fraction resulting from a process of catalytic cracking of an atmospheric distillation residue or of a vacuum distillate of a crude oil. The gasoline fraction resulting from the catalytic cracking, which represents on average 40% of the gasoline bases, in fact contributes more than 90% of the sulphur introduced into the gasolines. Consequently, the production of low-sulphur gasolines requires a stage of desulphurization of the catalytically cracked gasolines. This desulphurization is usually carried out by one or more stages of bringing the sulphur compounds contained in said gasolines into contact with a hydrogen-rich gas in a so-called hydrodesulphurization process. However, the catalysts used during the hydrodesulphurization stages are deactivated by the deposit of polymers. The precursors of these polymers are essentially conjugated diene-type polyunsaturated compounds which polymerize easily. It is therefore useful, before hydrodesulphurization, to carry out selective hydrogenation of the gasolines making it possible to significantly reduce the polyunsaturates content, without however significantly hydrogenating the olefins, which would cause the octane number to drop.

The industry is therefore seeking to produce hydrocarbonated fractions, the polyunsaturated compound, or diolefin, contents of which are generally less than 1% by weight, and preferably 0.5% by weight and very preferably 0.2% by weight. For this purpose, the principal reaction implemented is the reaction of selective hydrogenation of the diolefins to olefins. Apart from this reaction, reactions of isomerization of the position of the double bond of the olefins is also observed.

These reactions lead to an increase in the level of olefins in an internal position, which generally makes it possible to improve the octane number of the olefins.

Moreover, the catalytically cracked gasolines contain saturated sulphur compounds which are capable of reacting in the presence of hydrogen and olefins in order to form saturated sulphur compounds with an increased boiling point. These compounds are concentrated in the light fractions of the gasoline. In particular, in the cracked gasolines such as the FCC (catalytically cracked) gasolines, the sulphur compounds, the boiling point of which is lower than that of thiophene are mostly saturated sulphur compounds of mercaptan or sulphide type, and their weight increase makes it possible to considerably reduce the sulphur content of the light gasoline fraction. Among these reactions, the most sought-after are the so-called thioetherification reactions which consist of adding mercaptan compounds to olefins. It has in particular been observed that this reaction requires the presence of hydrogen.

The catalytic system as well as the operating conditions can therefore advantageously be optimized in order to allow the conversion of the saturated sulphur compounds. The conversion by weight increase of these compounds makes it possible to produce a low-sulphur light gasoline, all without hydrogenation of the olefins and therefore without loss of octane. In order to take full advantage of these conversion reactions of the sulphur compounds for the purpose of desulphurization of olefinic gasolines, it is advantageous to separate the gasoline thus produced into two fractions: a light fraction rich in olefinic compounds and practically devoid of sulphur compounds, and a heavy fraction which concentrates the sulphur compounds and which is treated in a desulphurization unit. The reactions implemented for the conversion of the sulphur compounds are described in detail in the patent application FR 2 797 639.

The hydrogenation reactions of the polyunsaturates and weight increase of the mercaptans as well as the processes implemented are described in detail in the patent application US 02/0153280. The process carrying out these reactions necessarily uses hydrogen.

The selective hydrogenation and hydrodesulphurization processes can use hydrogen originating from several sources. The main source of hydrogen in the refinery is catalytic reforming. The catalytic reforming unit produces hydrogen during reactions of dehydrogenation of naphthenes to aromatics and dehydrocyclization. This hydrogen has a purity level generally comprised between 60% and 90%, but it is more or less devoid of CO and $CO_2$.

Depending on the needs of the refinery, the hydrogen can also be produced by steam reforming of light hydrocarbons or by partial oxidation of various hydrocarbons, in particular of heavy residues. Steam reforming consists of converting a light hydrocarbon feedstock to synthesis gas (mixture of $H_2$, CO, $CO_2$, $CH_4$, $H_2$0) by reaction with water vapour on a nickel-based catalyst. The production of hydrogen by partial oxidation consists of treating a hydrocarbon fraction by oxidation with oxygen at a high temperature in order to produce a synthesis gas constituted mainly of CO, $CO_2$, $H_2$, and $H_2O$. In the last two cases the production of hydrogen is accompanied by a production of carbon oxides which are generally more or less eliminated by steam conversion of CO to $CO_2$, then elimination of the $CO_2$ by absorption, for example by a solution of amines. There can be a final elimination of the residual CO by methanation. However the residual carbon oxide (CO and $CO_2$) contents can in certain cases be greater than 1000ppmv or even more. Other sources of hydrogen are also sometimes used, such as hydrogen originating from the catalytically cracked gases which contain considerable quantities of CO and $CO_2$. Finally, CO and $CO_2$ can be introduced in certain cases by the hydrocarbon feedstock itself, in the form of dissolved gas, if the feedstock has been in contact with traces of these gases upstream.

The refinery hydrogen, and the hydrogen in the reaction zone of the different hydrotreatments can therefore contain variable quantities of CO and $CO_2$.

The patent application US 2003/0221994 describes the impact of CO and $CO_2$ on the reactions of hydrodesulphurization of the gasoline cuts originating from the catalytic cracking unit. The results presented in this patent show that the presence of carbon oxides in the hydrogen even at very low levels of less than 100 ppmv causes a significant reduction in the hydrodesulphurizing activity of the sulphide catalysts. However, in the range of CO levels tested, this inhibition is selective of the hydrodesulphurization reactions, and the hydrogenation reactions are relatively unaffected. Thus, according to the data provided by this document, the hydrogenating activity of the sulphide catalysts is not significantly affected by the presence of carbon oxides in the hydrogen.

However, surprisingly, it has been found by the applicant that the presence of carbon oxides significantly degraded the activity of the catalysts utilized in the selective hydrogenation processes on sulphurized catalysts.

SUMMARY DESCRIPTION OF THE INVENTION

The invention relates to a process for the hydrotreatment of an olefinic gasoline feedstock for at least the reduction of its content of diolefinic and acetylenic compounds, comprising at least a stage a1) or c) of selective hydrogenation on a catalyst comprising, on an inert support, at least one sulphide of an element of the group constituted by iron, cobalt and nickel (and preferably of the subgroup constituted by cobalt and nickel), typically obtained by presulphurization of this element in the form of oxide, in which the makeup hydrogen used in this stage has a $CO+CO_2$ content of less than 1000 ppmv (parts per million by volume), preferably less than 500 ppmv, or even 200 ppmv and very preferably less than 100 ppmv. The $CO+CO_2$ content is often comprised between 1 and 1000 ppmv, or between 5 and 1000 ppmv, preferably comprised between 1 and 500 ppmv, or between 5 and 500 ppmv, or even comprised between 1 and 200 ppmv, or between 5 and 200 ppmv, or between 10 and 200 ppmv, or between 20 and 200 ppmv, or between 50 and 200 ppmv, and very preferably comprised between 1 and 100 ppmv, or between 5 and 100 ppmv, or between 20 and 100 ppmv. The CO content is typically considerably lower, often comprised between 1 and 20 ppmv, preferably between 1 and 10 ppmv, for example very preferably between 1 and 8 ppmv or between 1 and 5 ppmv. The $CO_2$ content, often greater than the CO content, is often greater than 10 ppmv or 20 ppmv.

These conditions make it possible to obtain a high catalytic efficiency, and to use various sources of hydrogen. They do not mean that the hydrogen is produced exclusively by catalytic reforming and/or completely purified by molecular sieve.

DETAILED DESCRIPTION OF THE INVENTION

It has in fact been found that the carbon oxides have an inhibiting action on selective hydrogenation in the case of active elements of the catalyst in the form of sulphides, in particular in the case of nickel or cobalt sulphides, in particular in the presence of molybdenum sulphide or tungsten sulphide (or of a sulphide of another element of Group VI B of the periodic table of the elements).

This is not known from the prior art.

Typically, the selective hydrogenation catalyst comprises at least one nickel or cobalt sulphide, and is more or less free of elements of Group VIII of the periodic table of the elements, other than iron, nickel or cobalt. Preferably, it also contains a molybdenum sulphide. A very preferred composition of the catalyst comprises at least one nickel or cobalt sulphide (in particular Ni) with an Ni or Co content in NiO or CoO oxide equivalent comprised between 1 and 30%, also comprises at least one molybdenum sulphide with an Mo content in MoO3 oxide equivalent comprised between 1 and 30% by weight and is more or less free of elements of Group VIII of the periodic table of the elements, other than iron, nickel or cobalt.

These contents are usually evaluated by convention, in oxide equivalent, i.e. by evaluating the weight which the corresponding oxide would have. This calculation is conventional to the extent that the element is typically present in the sulphurized form and no longer oxide.

It has also been found that the CO, on the catalysts in sulphide form, was more inhibitive of selective hydrogenation than $CO_2$. For this reason, in the process according to the invention, the makeup hydrogen used in said stage a1) or c) generally has a CO content of less than 400 ppmv, preferably less than 200 ppmv, or even 80 ppmv, and very preferably less than 40 ppmv.

The CO content is often comprised between 1 and 400 ppmv, or between 5 and 400 ppmv, preferably comprised between 1 and 200 ppmv, or between 5 and 200 ppmv, or even comprised between 1 and 80 ppmv, or between 5 and 80 ppmv, and very preferably between 1 and 40 ppmv, or between 5 and 40 ppmv. It can even be comprised between 1 and 20 ppmv, or between 1 and 10 ppmv or between 1 and 8 ppmv or between 1 and 5 ppmv or between 5 and 20 ppmv.

Typically, the hydrogen is used in a single pass in said stage a1) or c). This makes it possible not to enrich the CO and/or $CO_2$ content by the recycling-loop effect.

Generally, the process according to the invention comprises stage a1) and a subsequent selective hydrodesulphurization stage b), carried out on at least part of the feedstock after treatment in stage a1). This stage b) takes advantage of the elimination of the very unsaturated compounds in a1). Generally, the catalyst and the operating conditions used in stage a1) are determined in order to simultaneously carry out an at least partial conversion of the sulphur products comprised in the feedstock by increasing their molecular weight, as described in the patent FP 2 797 639.

Optionally, the process can comprise a stage a2) subsequent to stage a1) and prior to stage b), in order to carry out an at least partial conversion of sulphur products by increasing their molecular weight.

It has also been found that the reactions increasing the molecular weight of sulphur products, in particular of light mercaptans, are also inhibited by the presence of considerable quantities of CO and/or $CO_2$ in the hydrogen used, in particular for the abovementioned sulphide-type catalysts. However, it seams that the extent of the inhibition may be different from that of selective hydrogenation.

For this stage a2), it is possible to use hydrogen having any one of the abovementioned limitations (maximum content or content range in ppmv) of CO and/or $CO_2$. In particular: a CO content of less than 400 ppmv, preferably less than 200 ppmv, or even 80 ppmv, and very preferably less than 40 ppmv; a CO content often comprised between 1 and 400 ppmv, or between 5 and 400 ppmv, preferably comprised between 1 and 200 ppmv, or between 5 and 200 ppmv, or even comprised between 1 and 80 ppmv, or between 5 and 80 ppmv, and very preferably comprised between 1 and 40 ppmv, or between 5and 40 ppmv. It can even be comprised between 1 and 20 ppmv, or between 5 and 20 ppmv.

The catalysts and conditions described in the patent FP 2 797 639 can be used for stages a1), a2), as well as for the selective hydrosulphurization b), in particular of the heavy fraction, in one or more stages.

Optionally, the process can comprise a selective hydrodesulphurization stage b), on at least part of the effluent from a selective hydrogenation stage. There can also be a selective hydrogenation stage subsequent to stage b), or 2 selective hydrogenation stages, the first preliminary a1), the second c) subsequent to the selective hydrodesulphurization stage b).

Typically, the process according to the invention comprises:

a stage al of selective hydrogenation and at least partial conversion of sulphur products by increasing their molecular weight on an alumina-based catalyst comprising at least a nickel or cobalt sulphide (the Ni or Co content relative to the catalyst being comprised between 1 and 30%, preferably between 1 and 20% and very preferably between 2 and 15% by weight of NiO and/or CoO-type oxide equivalent), optionally but preferably comprising molybdenum in sulphurized form (Mo content comprised between 1 and 30%; preferably between 5 and 30%; and very preferably between 5 and 25% by weight of MoO3-type oxide equivalent) and more or less free of elements of Group VIII of the periodic table of the elements, other than iron, nickel or cobalt, under pressure conditions comprised between 0.5 and 4 MPa, temperature conditions comprised between 100 and 250° C., space velocity comprised between 1 and $10h^{-1}$, and subsequently, a fractionation stage for producing at least one light fraction and one heavy fraction, a stage b) of selective hydrodesulphurization of at least said heavy fraction under pressure conditions comprised between 0.5 and 4 MPa, temperature conditions comprised between 200 and 400° C., space velocity comprised between 1 and $10\ h^{-1}$, in which the makeup hydrogen used in this stage has a CO content of less than 100 ppmv and a $CO_2$ content of less than 400 ppmv. Preferably, the process according to the present invention typically comprises a stage of selective hydrogenation of hydrocarbon fractions boiling in the range of the gasolines containing unsaturated and polyunsaturated compounds as well as sulphur, and simultaneously of weight increase of the light saturated sulphur compounds, for which the hydrogen used contains less than 400 ppmv and preferably less than 200 ppmv, or even 50 ppmv of carbon oxides in the form of CO or $CO_2$.

Any known method making it possible to reduce the carbon oxides content can be used to produce a hydrogen corresponding to the abovementioned specifications according to the present invention.

Purification of Hydrogen:

Among the methods most commonly used to eliminate the carbon oxides (CO, $CO_2$) from the hydrogen, we can mention "PSA, or pressure swing adsorption" which signifies "adsorption by pressure variation", or "TSA, or thermal swing adsorption" which signifies "adsorption by thermal variation". These two processes consist of adsorbing the carbon oxides on a molecular sieve in order to produce a hydrogen which is low in carbon, then desorbing the carbon oxides by pressure or temperature variation. Methanation is also a method which can be used within the scope of the invention. This process consists of treating the mixture of hydrogen and carbon oxides on a hydrogenating catalyst such as nickel on alumina in order to convert the carbon oxides to $CH_4$ and $H_2O$. Another solution consists of oxidizing the carbon monoxide to carbon dioxide, either by reaction with water according to the process called "water gas shift", or by selective oxidation of the CO to $CO_2$ by oxygen. The latter reaction is in particular described in the patent application WO 01/0181242. After oxidation of the CO to $CO_2$, the $CO_2$ formed can be eliminated during a washing stage using a methyldiethanolamine solution. The possibility of separating the carbon oxides from the hydrogen by using membranes permeable to hydrogen and impermeable to carbon oxides should also be mentioned.

The solution utilized for treating and purifying hydrogen can be chosen from the above non-limitative list, but can also consist of a combination of different solutions.

Useable Feedstocks:

The hydrocarbon fractions which are the subject of the invention are preferably cuts, the final distillation point of which is less than 300° C. and preferably less than 250° C. The invention applies more particularly to gasolines (this term designating unsaturated hydrocarbon fractions essentially boiling between 30 and 230° C., in ASTM distillation) containing at least 5% by weight of olefins, 40 ppm by weight of sulphur and/or 0.5% by weight of diolefins. These gasolines have generally originated from catalytic or thermal cracking units, such as for example FCC, coking or steam cracker.

Preparation of the Catalyst (Stages a1 and Optionally a2):

The preferred catalysts comprise an element of Group VIII (preferably Ni or Co) and preferably an element of Group VIb (preferably Mo or W). The most preferred composition uses nickel and molybdenum.

These metals are deposited in the form of oxides on an inert porous support, such as for example alumina, silica or a support containing at least 50% alumina by weight. Preferably, a catalyst containing nickel and molybdenum will be used such that the nickel oxide NiO content is comprised between 1% by weight and 20% by weight, and the molybdenum oxide $MoO_3$ content is comprised between 5% by weight and 25% by weight.

The catalyst must be utilized in sulphurized form, i.e. the metal oxides are converted to sulphides. The sulphurization of the catalyst is carried out by any methods known to a person skilled in the art. Usually the sulphurization is carried out by a thermal treatment of the catalyst in contact with an organic sulphur compound which is decomposable and generates $H_2S$ or directly in contact with a flow of $H_2S$ diluted in hydrogen. This sulphurization stage can be carried out in situ or ex situ (inside or outside the reactor) at temperatures comprised between 100° C. and 500° C. and more preferentially at temperatures comprised between 200° C. and 400° C.

Preferred Operating Conditions (Stages a1 and Optionally a2):

The catalyst is preferably utilized in a fixed bed. The operating pressure is comprised between 0.4 and 5 MPa and preferably between 0.5 and 4 MPa, typically greater than 1 MPa. The hourly space velocity (which corresponds to the volume of liquid feedstock per volume of catalyst) is comprised between approximately $1\ h^{-1}$ and $20\ h^{-1}$, preferably between $1\ h^{-1}$ and $10\ h^{-1}$, and very preferably between $1.5\ h^{-1}$ and $10\ h^{-1}$. The hydrogen flow rate is adjusted in such a manner that the molar ratio between the hydrogen and the diolefins is greater than 1.1 and preferably greater than 1.5. The excess of hydrogen favours the hydrogenation of the diolefins, however, if the hydrogen is introduced in too great an excess, it can react with the olefins to form paraffins and therefore cause a loss of octane from the gasoline. Consequently, the molar ratio between the hydrogen and the diolefins must preferably be less than 5 and very preferably less than 3. The temperature is comprised between 50 and 250° C., preferably between 100 and 250° C., and very preferably between 80 and 200° C. The temperature can be adjusted in order to obtain the sought conversion rate of the diolefins.

The entire disclosures of all applications, patents and publications, cited herein and of corresponding French application No. 04/12.592, filed Nov. 26, 2004 are incorporated by reference herein.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A process for the hydrotreatment of an olefinic gasoline feedstock containing diolefinic and acetylenic compounds so as to reduce at least the diolefinic and acetylenic compounds content, comprising at least one of stages (a1) and (c) of selective hydrogenation on a catalyst comprising, on an inert support, at least a sulphide of an element of the group of iron, cobalt and nickel, and passing to said at least one of stages (a1) and (c), makeup hydrogen having a $CO + CO_2$ content comprised between 5 and 200 ppmv and a CO content comprised between 1 and 20 ppmv.

2. A process according to claim 1 wherein said catalyst comprises at least a nickel or cobalt sulphide, and is substantially free of elements of Group VIII of the periodic table of the elements, other than iron, nickel and cobalt.

3. A process according to claim 2 wherein said catalyst comprises at least a nickel or cobalt sulphide having an Ni or Co content in oxide equivalent terms, comprised between 1 and 30%, and also comprises at least one molybdenum sulphide with an Mo content in oxide equivalent terms comprised between 1 and 30% by weight and is substantially free of elements of Group VIII of the periodic table of the elements, other than iron, nickel and cobalt.

4. A process according to claim 1 wherein the makeup hydrogen in said at least one of stages (a1) and (c) has a CO content of between 1 and 10 ppmv.

5. A process according to claim 1 comprising passing hydrogen in a single pass in said at least one of stages (a1) and (c).

6. A process according to claim 1, comprising said stage (a1) and a subsequent stage (b) comprising subjecting at least part of the feedstock after treatment in stage (a1) to selective hydrodesulphurization.

7. A process according to claim 6 wherein the catalyst and the operating conditions used in stage (a1) are adjusted to simultaneously carry out an at least partial conversion of sulphur products comprised in the feedstock so as to increase the molecular weight of said sulphur products.

8. A process according to claim 6, comprising a stage (a2) subsequent to stage (a1) and prior to stage (b) comprising conducting an at least partial conversion of sulphur products so as to increase the molecular weight of said sulphur products.

9. A process according to claim 1 further comprising a selective hydrodesulphurization stage (b), and subsequently conducting said selective hydrogenation stage (c) on at least part of an effluent from stage (b).

10. A process according to claim 6, comprising:

a stage (a1) of selective hydrogenation and at least partial conversion of sulphur products by increasing their molecular weight on an alumina-based catalyst comprising at least a nickel or cobalt sulphide and substantially free of elements of Group VIII of the periodic table of the elements, other than iron, nickel and cobalt, under pressure conditions comprised between 0.5 and 4 MPa, temperature conditions comprised between 100 and 250° C., space velocity comprised between 1 and 10 $h^{-1}$, and subsequently, subjecting effluent from said stage (a1) to a fractionation stage for producing at least one light fraction and one heavy fraction, a stage (b) subjecting at least said heavy fraction to selective hydrodesulphurization under pressure conditions comprised between 0.5 and 4 MPa, temperature conditions comprised between 200 and 400°C., space velocity comprised between 1 and 10 $h^{-1}$, and providing makeup hydrogen having a CO content of between 1 and 10 ppmv and a $CO_2$ content of less than 400 ppmv.

11. A process according to claim 2 wherein the makeup hydrogen in said stage (a1) or (c) has a CO content of between 1 and 10 ppmv.

12. A process according to claim 3 wherein the makeup hydrogen in said stage (a1) or (c) has a CO content of between 1 and 10 ppmv.

13. A process according to claim 6 wherein the makeup hydrogen in said stage (a1) or (c) has a CO content of between 1 and 10 ppmv.

14. A process according to claim 7 wherein the makeup hydrogen in said stage (a1) or (c) has a CO content of between 1 and 10 ppmv.

15. A process according to claim 8 wherein the makeup hydrogen in said stage (a1) or (c) has a CO content of between 1 and 10 ppmv.

16. A process according to claim 9 wherein the makeup hydrogen in said stage (a1) or (c) has a CO content of between 1 and 10 ppmv.

17. A process according to claim 1, comprising a single hydrogenation stage of either stage (a1) or (c).

18. A process according to claim 1, comprising two hydrogenation stages (a1) and (c).

* * * * *